US006288977B1

(12) United States Patent
Yoshida et al.

(10) Patent No.: US 6,288,977 B1
(45) Date of Patent: Sep. 11, 2001

(54) TIME SIGNAL REPEATER AND TIME CORRECTION SYSTEM USING THE SAME

(75) Inventors: Shinya Yoshida, Tatebayashi; Masahiro Tanoguchi, Tokyo; Kenichi Nemoto, Shiraoka-machi; Akinari Takada, Mitaka; Kenji Fujita, Sayama; Masahiro Sase, Fussa, all of (JP)

(73) Assignees: Rhythm Watch Co. Ltd.; Citizen Watch Co., Ltd., both of Tokyo (JP)

( * ) Notice: Subject to any disclaimer, the term of this patent is extended or adjusted under 35 U.S.C. 154(b) by 0 days.

(21) Appl. No.: 09/512,288

(22) Filed: Feb. 24, 2000

(30) Foreign Application Priority Data

Feb. 25, 1999 (JP) ..... 11-049001

(51) Int. Cl.[7] ..... G04C 11/02
(52) U.S. Cl. ..... 368/47; 368/187
(58) Field of Search ..... 368/10, 47, 187; 455/73, 78; 340/310.06, 310.07

(56) References Cited

U.S. PATENT DOCUMENTS

| | | | | |
|---|---|---|---|---|
| 4,083,004 | * | 4/1978 | Cohn | 325/6 |
| 4,210,901 | * | 7/1980 | Whyte et al. | 340/31 R |
| 5,245,591 | | 9/1993 | Katou . | |
| 5,331,610 | | 7/1994 | Kikuchi . | |
| 5,677,895 | * | 10/1997 | Mankovitz | 368/47 |
| 6,219,302 | * | 4/2001 | Tanoguchi et al. | 368/47 |

FOREIGN PATENT DOCUMENTS 5333170 12/1993 (JP) .

* cited by examiner

*Primary Examiner*—Vit Miska
*Assistant Examiner*—Jeanne-Marguerite Goodwin
(74) *Attorney, Agent, or Firm*—Birch, Stewart, Kolasch & Birch LLP.

(57) ABSTRACT

A time signal repeater, capable of selectively relaying standard time radio signals having different modulation frequencies and correcting the time based on the plurality of standard time radio signals without changing a radio correction clock side, including an antenna portion capable of receiving a standard time radio signal by a set resonance frequency, an oscillating circuit outputting a signal having a frequency of the received standard time radio signal in synchronization with the standard time radio signal received by the antenna portion, at least one frequency conversion circuit converting the frequency of the output signal of the oscillating circuit, a receiving circuit receiving as input the standard time radio signal received by the antenna portion and correcting a time of an internal clock according to a time code included in the received radio signal, a transmission circuit generating a time radio signal including a time code based on the internal clock based on the output signal of the oscillating circuit or the signal converted in frequency by the frequency conversion circuit at the time of transmission, and a selecting circuit receiving as input the output signal of the oscillating circuit or the signal converted in frequency by the frequency conversion circuit to the transmission system circuit, and a time correction system using the same.

4 Claims, 9 Drawing Sheets

IN THIS FIGURE, 114th day 17:25, DUT1=−0.3

TIME SIGNAL REPEATER AND TIME CORRECTION SYSTEM USING THE SAME

BACKGROUND OF THE INVENTION

1. Field of the Invention

The present invention relates to a time signal repeater which relays a radio signal including a time code for a radio correction clock receiving a radio signal to correct its time and to a time correction system using the same.

2. Description of the Related Art

A radio correction clock receives, for example, a standard time radio signal of a long wave (for example, 40 kHz in Japan) transmitting a standard time and corrects the time based on the received radio signal to display the precise time.

This type of radio correction clock has built into it a receiving circuit receiving a standard time radio signal and a control circuit for driving a hand driving system based on the received signal to correct the time. In the radio correction clock, the positions of the hands are corrected to positions according to the time code of the received radio signal.

A radio correction clock exclusively receives the standard time radio signal. There are many cases where it is placed in a location which the radio signal can hardly reach, for example, is in an apartment building or basement, and cannot receive the signal.

In order to eliminate this restriction on the location where the radio correction clock is placed, it has been proposed to provide a time signal repeater for receiving the standard time radio signal and modulating the received time signal by a predetermined carrier and transmitting the modulated signal, and to have the radio correction clock receive the signal transmitted from the repeater to correct the time (see for example Japanese Unexamined Patent Publication (Kokai) No. 5-333170).

Summarizing the problem to be solved by the invention, the modulation frequency of the standard time radio signal differs by country.

For example, the modulation frequency is 40 kHz in Japan, 60 kHz in the U.S., and 77.5 kHz in Germany.

As opposed to this, in the time signal repeaters currently proposed, the resonance frequency of the receiving antenna portion is fixed, so it is possible to use the repeaters in only one country.

Further, it may be considered to change the reception frequency of the radio correction clock to the frequency of the time signal repeater. This change, however, would be complicated and would involve both hardware and software, therefore this is not practical in terms of cost etc.

SUMMARY OF THE INVENTION

An object of the present invention is to provide a time signal repeater capable of selectively relaying standard time radio signals having different modulation frequencies and thereby enabling correction of time based on a plurality of standard time radio signals without changes at the radio correction clock side and a time correction system using the same.

According to a first aspect of the present invention, there is provided a time signal repeater which relays a radio signal including a time code for a radio correction clock receiving a standard time radio signal to correct the time, comprising an antenna portion capable of setting a plurality of resonance frequencies and receiving the standard time radio signal by a set resonance frequency, an oscillating circuit for outputting a signal having a frequency of the received standard time radio signal and synchronized with the standard time radio signal received by the antenna portion, at least one frequency conversion circuit for converting the frequency of the output signal of the oscillating circuit, a receiving circuit for receiving as input the standard time radio signal received by the antenna portion and correcting the time of an internal clock according to the time code included in the received radio signal, a transmission circuit for generating a time radio signal including a time code based on the internal clock based on the output signal of the oscillating circuit or the signal converted in frequency by the frequency conversion circuit at the time of transmission, and a selecting circuit for receiving as input the output signal of the oscillating circuit or the signal converted in frequency by the frequency conversion circuit to the transmission circuit.

According to a second aspect of the present invention, there is provided a time correction system comprising a radio correction clock fixed in reception frequency, receiving a standard time radio signal or radio signal obtained by relaying the standard time signal, and correcting the time to a time according to a time code included in the received signal, and a time signal repeater which has an antenna portion capable of setting a plurality of resonance frequencies and receiving the standard time radio signal with a set resonance frequency, an oscillating circuit for outputting a signal having a frequency of the received standard time radio signal and synchronized with the standard time radio signal received by the antenna portion, at least one frequency conversion circuit for converting the frequency of the output signal of the oscillating circuit, a receiving circuit for receiving as input the standard time radio signal received by the antenna portion and correcting the time of an internal clock according to the time code included in the received radio signal, a transmission circuit for generating a time radio signal including a time code based on the internal clock based on the output signal of the oscillating circuit or the signal converted in frequency by the frequency conversion circuit at the time of transmission, and a selecting circuit for receiving as input the output signal of the oscillating circuit or the signal converted in frequency by the frequency conversion circuit to the transmission circuit.

Further, in the present invention, the transmission circuit modulates an input signal with a different modulation system from an amplitude modulation system of the standard time radio signal.

Summing up, according to the present invention, in the time signal repeater, the resonance frequency is set to a frequency corresponding to the modulation frequency of the standard radio signal transmitted from a radio transmission base station.

When a standard time radio signal having a predetermined format is transmitted from the radio transmission base station in this state, it is received by the receiving antenna portion of the time signal repeater and input to the oscillating circuit and the receiving circuit.

In the oscillating circuit, a signal having the frequency of the received standard time radio signal in synchronization with the standard time radio signal received at the antenna portion is output.

Further, in the receiving circuit, the internal clock is corrected the time according to the time code included in the standard time radio signal received by the antenna portion.

Then, at the time of transmission, when the frequency of the output signal of the oscillating signal is the same as the reception frequency of the radio correction clock, the output signal of the oscillating circuit is selected by the selecting circuit and input to the transmission circuit.

When the frequency of the output signal of the oscillating signal is different from the reception frequency of the radio correction clock, the output signal of the frequency conversion circuit, which converts the frequency of the output signal of the oscillating circuit to a frequency the same as the reception frequency of the radio correction clock, is selected by the selecting circuit and input to the transmission circuit.

In the transmission circuit, at the time of the transmission, a time radio signal including a time code based on the internal clock is generated based on the output signal of the oscillating circuit or the signal converted in frequency by the frequency conversion circuit and the generated signal is transmitted to the radio correction clock.

In the radio correction clock, the time correction is performed according to the time code included in the standard time radio signal or the radio signal transmitted from the time signal repeater.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

Below, preferred embodiments will be described with reference to the accompanying drawings.

Figure 1:
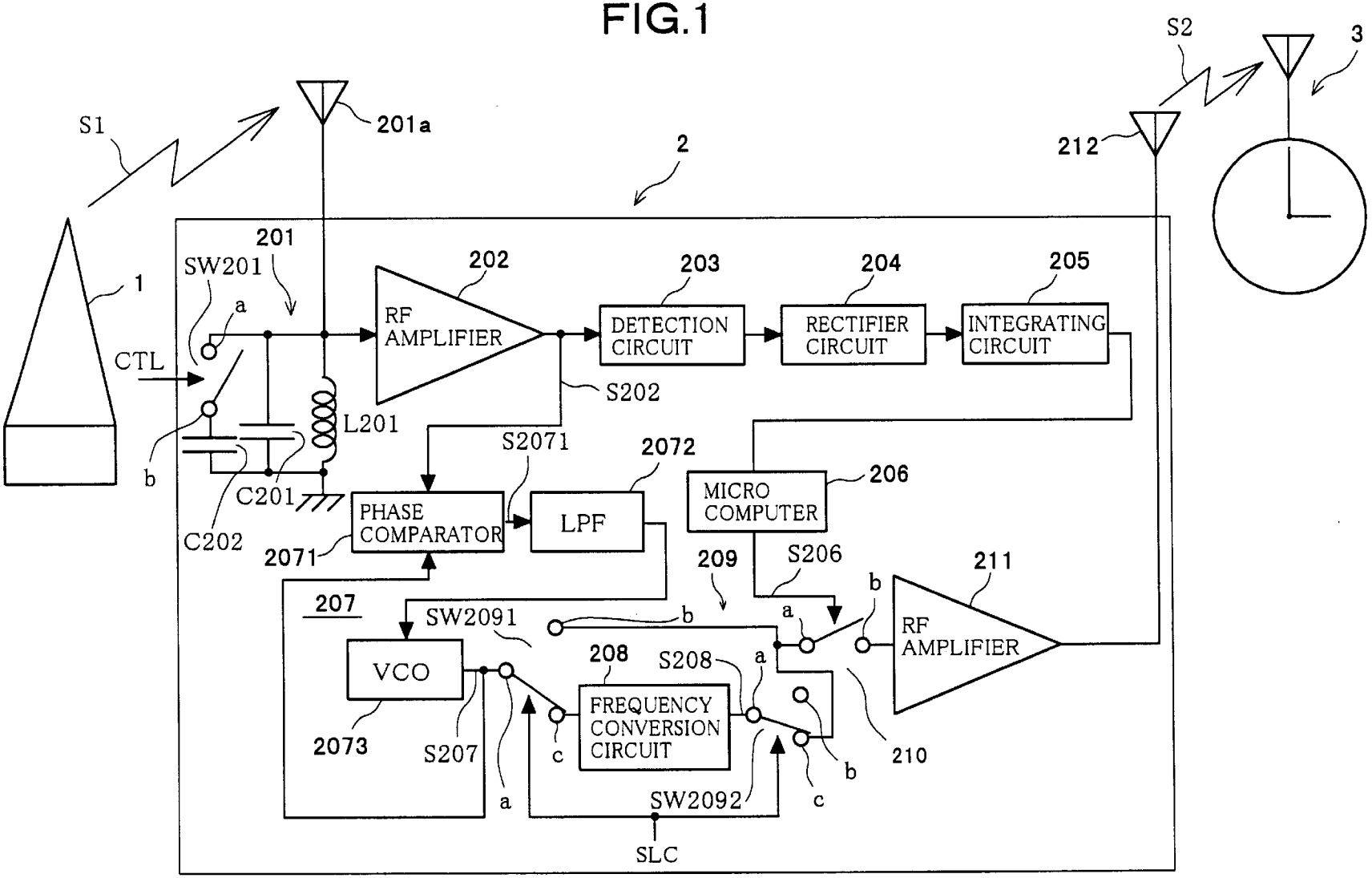
FIG. 1 is a block diagram of an embodiment of a time correction system using a time signal repeater according to the present invention.

FIG. 1 is a block diagram of an embodiment of a time correction system using a time signal repeater according to the present invention.

As shown in FIG. 1, the present time correction system is comprised of a radio transmission base station (hereinafter referred to as a "key station") 1 which transmits a standard time radio signal (JG2AS) with a long wave (40 kHz), a time signal repeater 2, and a radio correction clock 3.

Figure 2A:
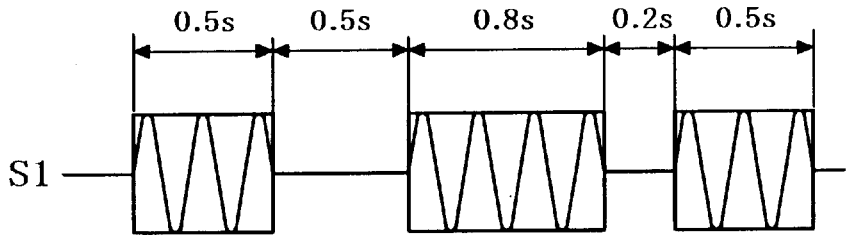
FIGS. 2A and 2B are views of principal waveforms of a time correction system using a time signal repeater according to the present invention.

The key station 1 performs amplitude modulation with respect to and transmits the long wave (40 kHz) standard time radio signal S1 of the format, for example, as shown in FIG. 2A.

The format of the long wave (40 kHz) standard time radio signal S1 sent by the key station 1 and transmitting the standard time at a high precision is specifically, in the case of a "1" signal, a signal of 40 kHz transmitted for a period of 500 ms (0.5 second) in one second, in the case of a "0" signal, a signal of 40 kHz transmitted for a period of 800 ms (0.8 second) in one second, and in the case of a "P" signal (synchronizing signal), a signal of 40 kHz transmitted for a period of 200 ms (0.2 second) in one second.

FIG. 2A shows an example of a waveform in the case where the data is (1,0,1).

Figure 3:
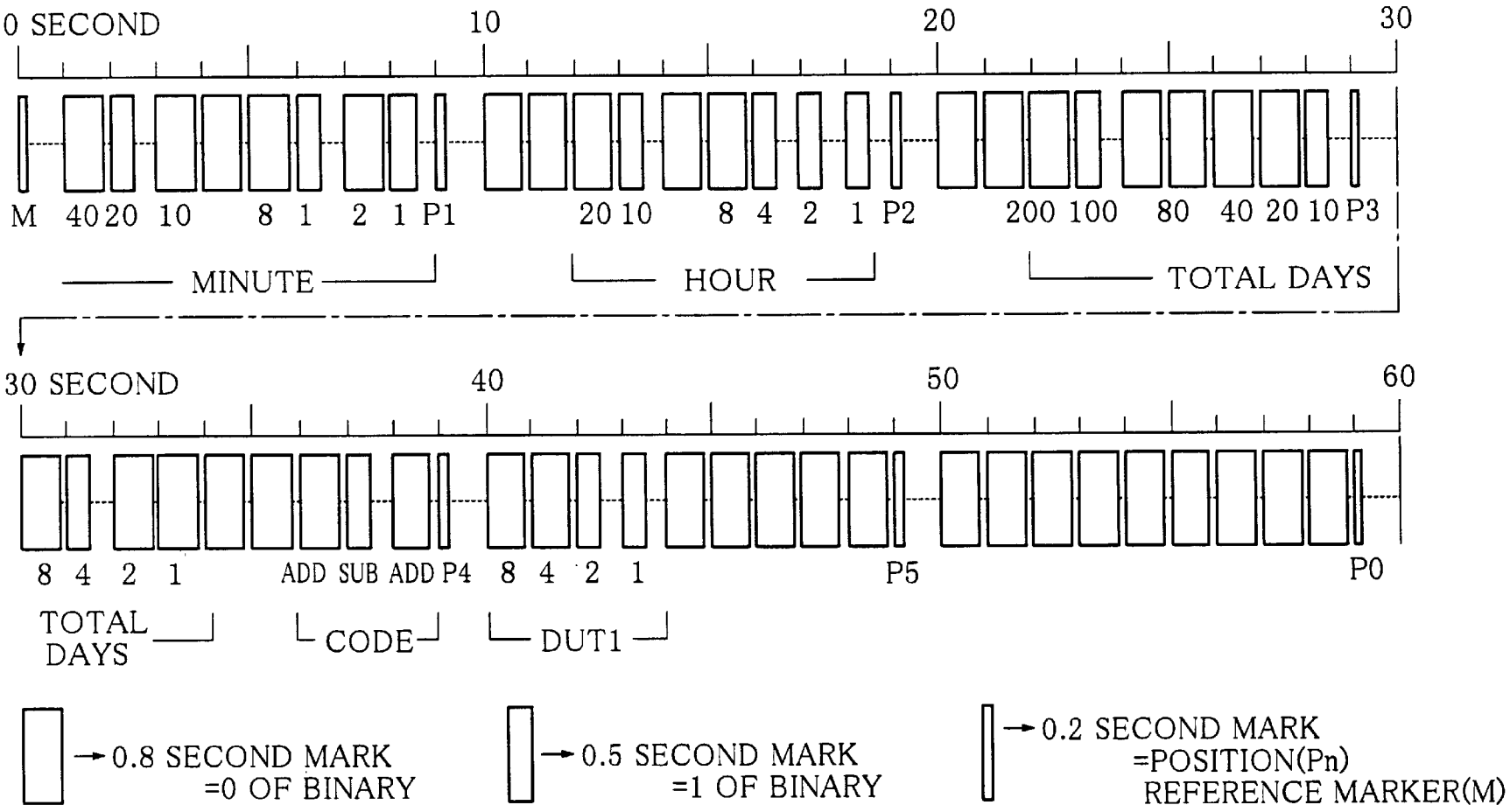
FIG. 3 is a view of an example of a time code of a standard time radio signal S1.

FIG. 3 shows an example of the time code of a standard time radio signal (JG2AS).

The example shows that it is the 114th day from January 1, 17:25. In this standard time radio signal, the code "0" continues nine consecutive times from the 50th second for synchronization use.

The time signal repeater 2 receives the standard time radio signal S1 including the time code and having a predetermined frequency (for example, 40 kHz or 60 kHz) amplitude modulated and transmitted from the key station 1, corrects the internal clock to the time according to the time code included in the received standard time radio signal, generates a time radio signal S2 having a frequency of 40 kHz included in the same frequency band of the standard radio signal, having the same format as a JG2AS baseband signal, and including a time code based on the corrected internal clock, and transmits the same to the radio correction clock 3 placed, for example, indoors in a predetermined transmission time band Specifically, as shown in FIG. 1, the time signal repeater 2 is configured by a receiving antenna portion 201, a reception use RF amplifier 202, a detection circuit 203, a rectifier circuit 204, an integrating circuit 205, a microcomputer 206, a phase locked loop (PLL) circuit 207 serving as an oscillating circuit, a frequency conversion circuit 208, a selecting circuit 209, an analog switch 210, a transmission use RF amplifier 211, and a transmission antenna 212.

The reception circuit is configured by the receiving antenna portion 201, the reception use RF amplifier 202, the detection circuit 203, the rectifier circuit 204, the integrating circuit 205, and the microcomputer 206, while the transmission circuit is configured by the microcomputer 206, the PLL circuit 207, the frequency conversion circuit 208, the selecting circuit 209, the analog switch 210, the transmission use RF amplifier 211, and the transmission antenna 212.

The receiving antenna portion 201 is capable of being set to a plurality of resonance frequencies, for example, 40 kHz and 60 kHz, so as to enable it to handle the frequencies of different standard time radio signals. Specifically, the receiving antenna portion 201 is configured by a resonance coil L201, capacitors C201 and C202, and switch SW201.

One end of the resonance coil L201 is connected to a first electrode of the capacitor C201 and a first contact a of the switch SW201, while another end is connected to second electrodes of the capacitors C201 and C202 and a ground line.

Further, a second contact b of the switch SW201 is connected to a first electrode of the capacitor C202.

Note that the resonance frequency is given by $\{1/(2\pi(LC)^{1/2}\}$.

Further, an inductance L of the resonance coil 201 is set to 1.583 mH, a capacity Ca of the capacitor C201 is set to 4.44 nF, and a capacity Cb of the capacitor C202 is set to 5.56 nF (Ca+Cb=10 nF).

The switch SW201 is set to ON and OFF by a control signal CTL.

In the case of the present configuration, when setting the resonance frequency to 40 kHz, the control signal CTL is set to a high level, then the switch SW201 is controlled to the ON state.

On the other hand, when setting the resonance frequency to 60 kHz, the control signal CTL is set to a low level, then the switch SW201 is controlled to the OFF state.

Note that, the level of the control signal CTL is set, for example, by the operation of a not illustrated change-over switch.

Figure 2B:
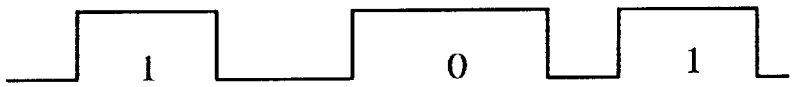

In the time signal repeater 2, the standard time radio signal S1 received by the receiving antenna portion 201 is converted to the baseband signal of the standard time radio signal S1 shown in FIG. 2B via the reception use RF amplifier 202, the detection circuit 203, the rectifier circuit 204, and the integrating circuit 205 and input to the microcomputer 206 and the PLL circuit 207.

Figure 4:
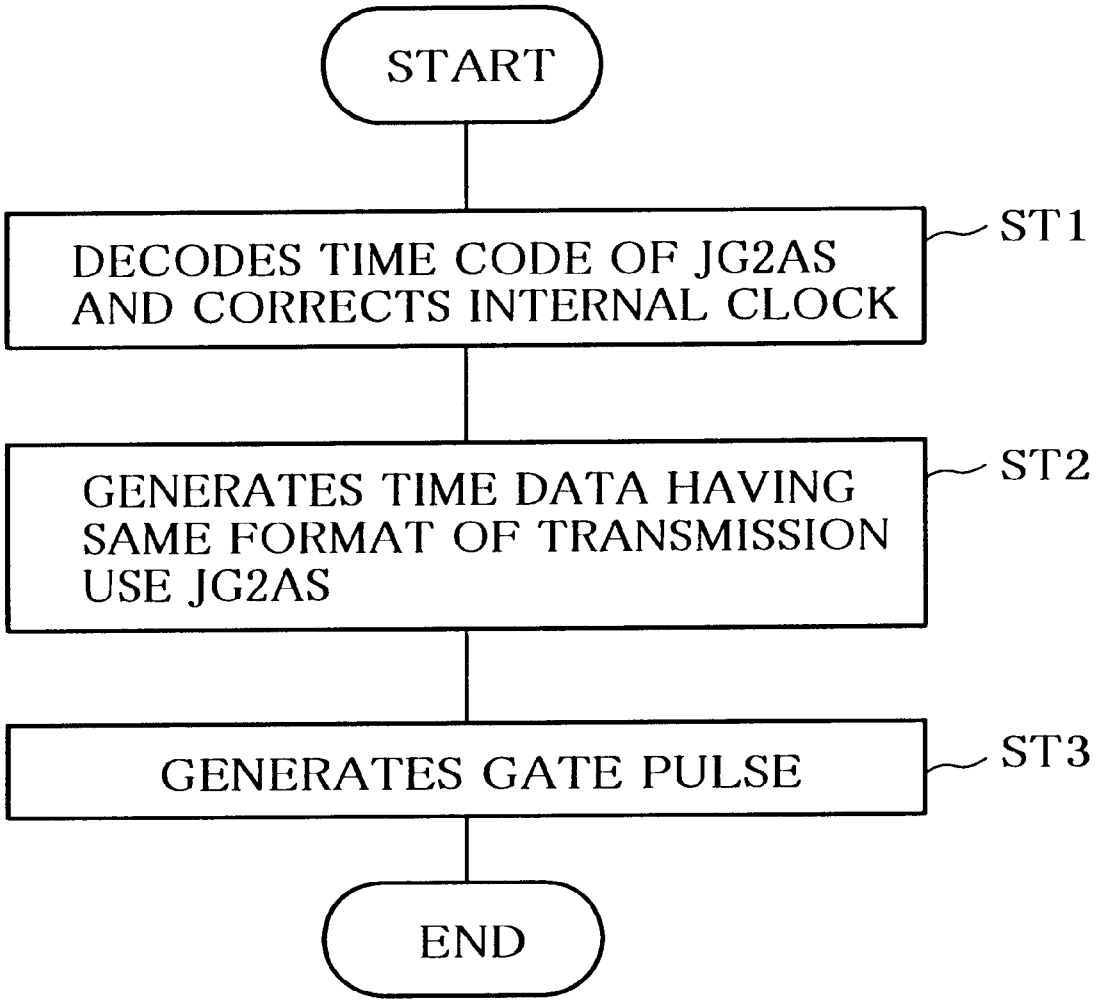
FIG. 4 is a flow chart for explaining an outline of processing of a microcomputer in a time signal repeater according to the present invention.

As shown in the flow chart of FIG. 4, the microcomputer 206 receives the baseband signal from the integrating circuit 205, decodes the time code of JG2AS, obtains the time data, for example, the hour:minute:00 second, and corrects the internal clock (ST1) accordingly.

Next, the microcomputer 206 generates the time data to be transmitted based on the time which the internal clock is counting in a predetermined transmission time band, for example, at 2:38 a.m. (ST2).

Then, the microcomputer 206 outputs the time data of the same format as the baseband signal of JG2AS to a control terminal of the analog switch 210 as a gate pulse S206 (ST3), makes the analog switch 210 generate a time radio signal S2, and makes the transmission use RF amplifier 211 transmit the same.

The PLL circuit 207 is configured by a phase comparator 2071, a low-pass filter (LPF) 2072, and a voltage-controlled oscillator (VCO) 2073.

The phase comparator 2071 is configured by for example a multiplier. The phase comparator 2071 compares a phase of the standard time signal S202 output from the RF amplifier 202 with a phase of an oscillating signal S207 output from the VCO 2073, and outputs a phase difference thereof to the LPF 2072 as a signal S2071.

Then, the PLL circuit 207 outputs an oscillating signal S207 synchronized in phase with the received standard time radio signal S1 and the same in frequency as the frequency of the standard time radio signal S1.

The frequency conversion circuit 208 is configured by for example a ⅔ frequency divider. The frequency conversion circuit 208 divides to ⅔ the 60 kHz frequency of the oscillating signal S207 from the PLL circuit 207 input via the selecting circuit 209 to convert the 60 kHz frequency to a 40 kHz frequency and outputs the same to the analog switch 210 via the selecting circuit 209.

The selecting circuit 209 inputs the oscillating signal S207 of the PLL circuit 207 directly or via the frequency conversion circuit 208 to the analog switch 210 according to the set level of a selection signal SLC.

The selecting circuit 209 is configured by a switch circuit SW2091 and a switch circuit SW2092.

A fixed contact a of the switch circuit SW2091 is connected to an output line of the oscillating signal S207 of the PLL circuit 207, a change-over contact b is connected to a contact a of the analog switch 210, and a change-over contact c is connected to an input line of the frequency conversion circuit 208.

A fixed contact a of the switch circuit SW2092 is connected to an output line of the frequency conversion circuit 208, a change-over contact b is held in an open state, and a change-over contact c is connected to a contact a of the analog switch 210.

When the frequency of the received standard time radio signal is 40 kHz, the selection signal SLC is for example set to a high level and the fixed contacts a of the switch circuits SW2091 and SW2092 are connected to the change-over contacts b thereof.

When the frequency of the received standard time radio signal is 60 kHz, the selection signal SLC is for example set to a low level and the fixed contacts a of the switch circuits SW2091 and SW 2092 are connected to the change-over contacts c thereof.

Note that the level of the selection signal SLC is set, for example, according to the operation of a not illustrated change-over switch.

The analog switch 210 turns on and off the oscillating signal S207 output from the PLL circuit 207 or the output signal S208 of the frequency conversion circuit 208 by the gate pulse S206 from the microcomputer 206 to obtain an amplitude modulated RF signal.

The amplitude modulated RF signal is amplified by the transmission use RF amplifier 211 and transmitted from the transmission antenna 212 as the radio signal S2 having the same format as JG2AS shown in FIG. 2A.

Note that, in the time signal repeater 2, a radio signal of 40 kHz from the transmission antenna 212 circulates to the receiving antenna portion 201, so the PLL circuit 207 is liable to find it hard to lock the phase synchronization loop, but it is possible to solve the problem explained below.

Figure 5A:
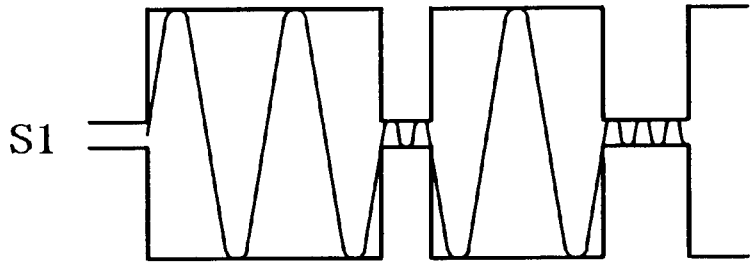
FIGS. 5A and 5B are views of an example of a concrete embodiment of a standard time radio signal and a relayed radio signal according to the present invention.

The 40 kHz standard time radio signal to be transmitted from June 1999 is a 100% to 10% amplitude modulated wave as shown in FIG. 5A.

Figure 5B:
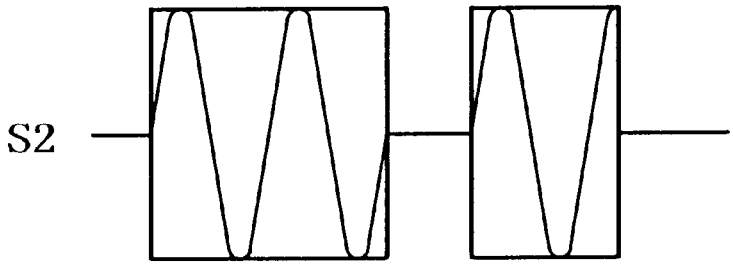

As opposed to this, as shown in FIG. 5B and FIG. 2A, the time radio signal S2 transmitted by the present time signal repeater 2 is transmitted as a 100% to 10% amplitude modulated wave, so the phase synchronization loop is locked at the PLL circuit 207 at a 0% transmission radio signal even if both the transmission frequency and reception frequency are 40 kHz.

Note that it is possible to configure the time signal repeater 2 so as to constantly transmit the radio signal S2, however, in the present embodiment, the time signal repeater 2 is configured so as to transmit the radio signal S2 one time a day only at a very special time, for example, at 2:38 a.m.

In principal, the radio correction clock 3 receives the predetermined frequency (40 kHz) standard time radio signal S1 including the time code amplitude modulated and transmitted from the key station 1 or the 40 kHz frequency time radio signal S2 transmitted from the time signal repeater 2, corrects the positions of the hands to the time indicated by the time code when the reception state of the standard time radio signal S1 or the time radio signal S2 is good, and informs the user of the poor reception of the radio signal when the reception state of the same is not good.

Figure 6:
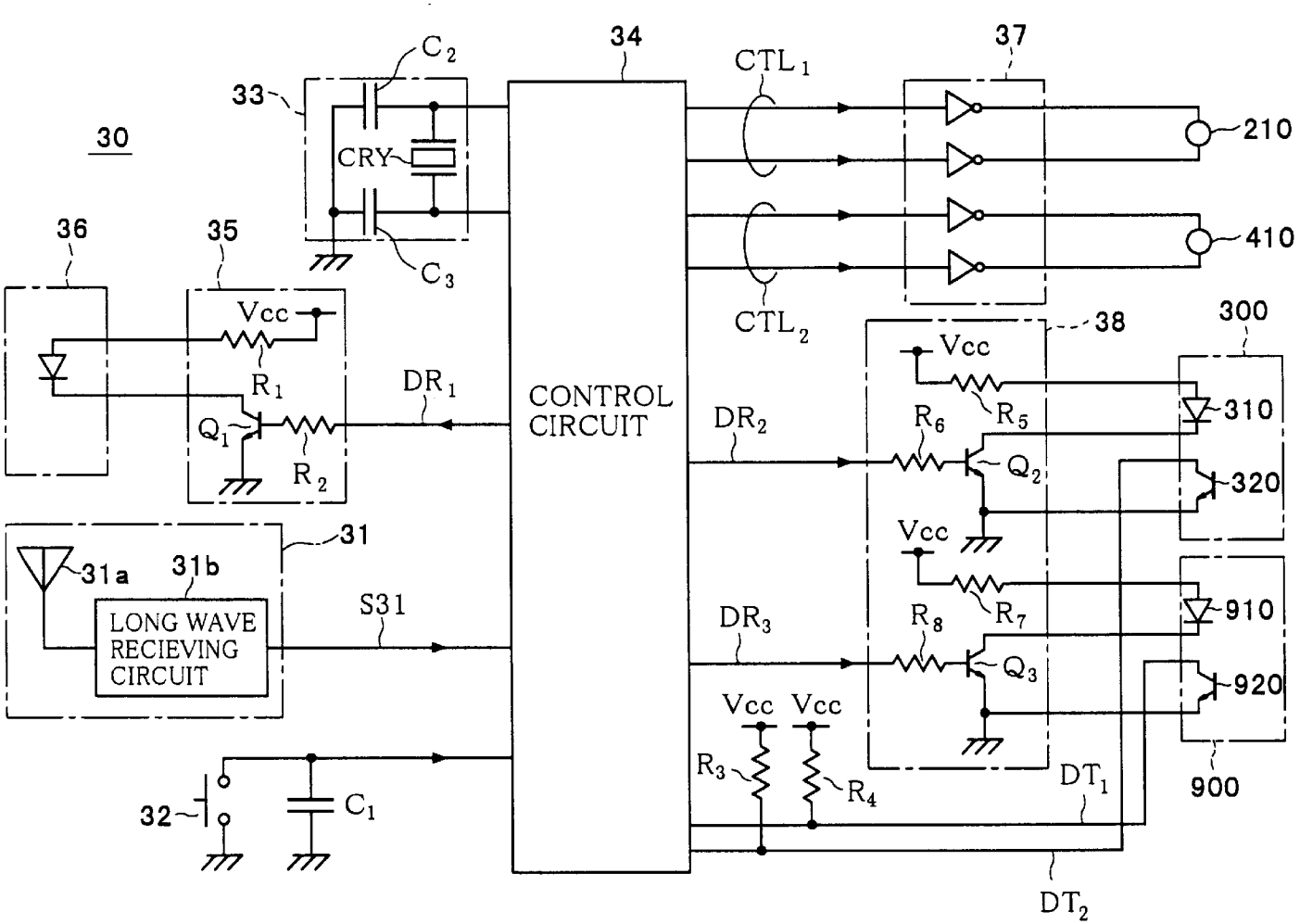
FIG. 6 is a block diagram of the configuration of an embodiment of a signal processing circuit of a radio correction clock according to the present invention.
Figure 7:
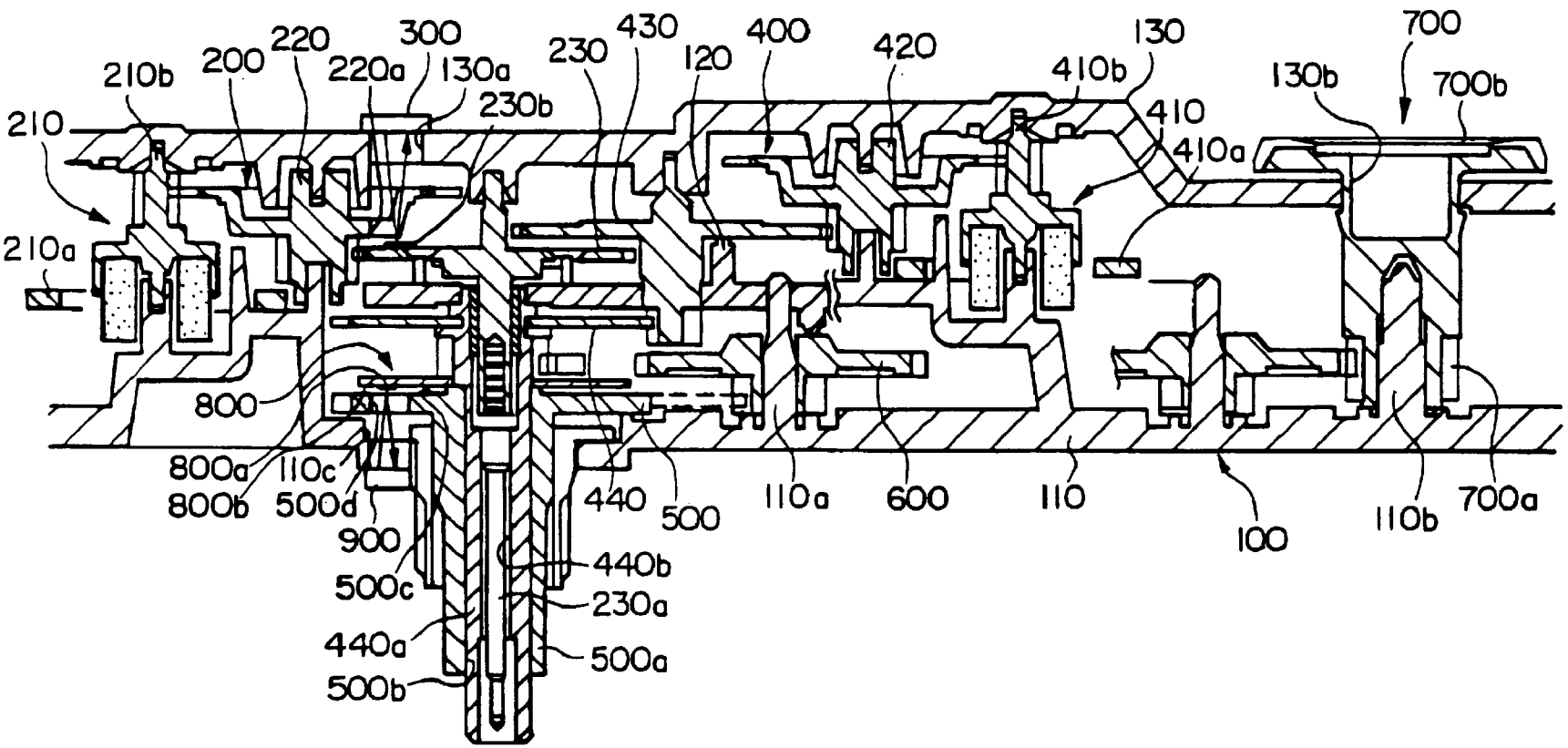
FIG. 7 is a sectional view of an embodiment of a hand position detecting apparatus of a radio correction clock according to the present invention.
Figure 8:
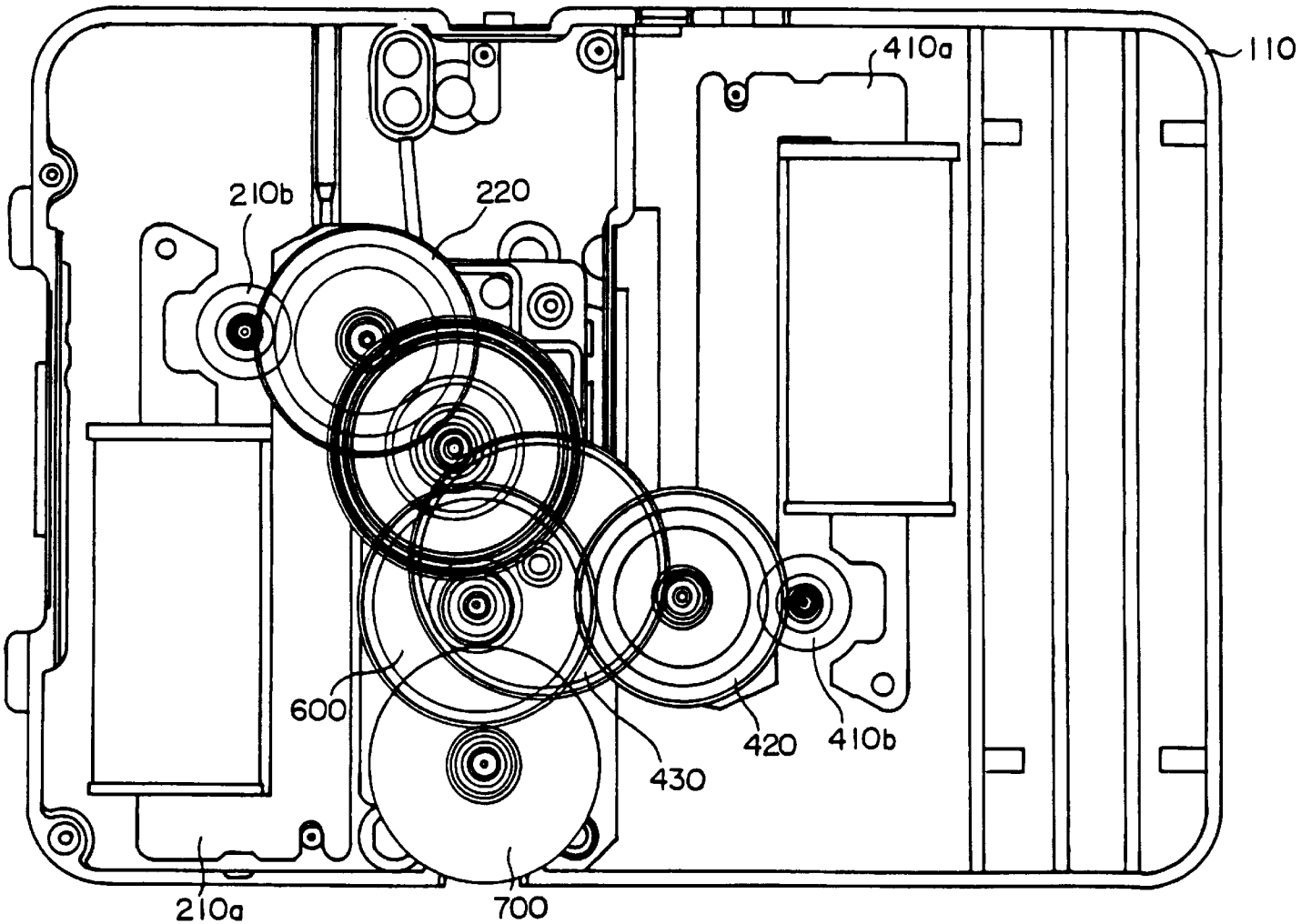
FIG. 8 is a principal plane view of a hand position detecting apparatus of a radio correction clock according to the present invention.

FIG. 6 is a block diagram of the configuration of an embodiment of the signal processing circuit of the radio correction clock according to the present invention, FIG. 7 is a sectional view of an embodiment of a hand position detecting apparatus of the radio correction clock according to the present invention, and FIG. 8 is a principal plane view of the hand position detecting apparatus of the radio correction clock according to the present invention.

In the figures, 30 denotes a signal processing circuit, 31 denotes a time radio signal receiving system, 32 denotes a reset switch, 33 denotes an oscillating circuit, 34 denotes a control circuit, 35 denotes a drive circuit, 36 denotes a light emitting element functioning as a warning means, 37 denotes a buffer circuit, 38 denotes a drive circuit, Vcc denotes a power source voltage, $C_1$ to $C_3$ denote capacitors, $R_1$ to $R_8$ denote resistance elements, 100 denotes a clock body, 200 denotes a second hand driving system, 300 denotes a first reflection type optical sensor, 400 denotes a minute hand driving system, 500 denotes an hour hand wheel, 600 denotes a minute (changing) wheel functioning as an intermediate wheel, 700 denotes a manual correction shaft, 800 denotes a rotary detection plate, and 900 denotes a second reflection type optical sensor.

The time radio signal receiving system 31 is configured by a receiving antenna 31*a* and a long wave receiving circuit 31*b* which receives a long wave (for example 40 kHz) including a time code signal transmitted, for example, by the key station 1, performs predetermined signal processing, and outputs the same as a pulse signal S31 to the control circuit 34. Note that, though not illustrated here, the long wave receiving circuit 31*b* is constituted by an RF amplifier, a detection circuit, a rectifier circuit, and an integrating circuit in the same way as the receiving system of the time signal repeater.

The reset switch 32 is turned on when the different states of the control circuit are returned to the initial state.

When the reset switch 32 is turned on or a not illustrated battery is set, the radio correction clock 3 enters an initial correction mode.

The oscillating circuit 33 is constituted by a crystal oscillator CRY and capacitors $C_2$ and $C_3$ and supplies a basic clock having a predetermined frequency to the control circuit 34.

The control circuit 34 has a not illustrated minute hand counter, second hand counter, standard minute and second counter, and the like. At the initial correction mode, the control circuit 34 receives the pulse signal S31 from the time radio signal receiving system 31 and for example compares a reception state of the received standard time radio signal with a predetermined reference range. When the reception state is within the reference range, the control circuit 34 outputs control signals $CTL_1$ and $CTL_2$ to a second hand use stepping motor 210 and an hour hand and minute hand use stepping motor 410 via the buffer 37 to initially set the positions of the hands, namely to reset them. When the reception state is outside the reference range, the control circuit 34 outputs a driving signal $DR_1$ to the drive circuit 35, without outputting the control signals $CTL_1$ and $CTL_2$, to cause the light emitting element 36 serving as the warning means to emit light and inform the user that reception of the radio signal is almost impossible.

Further, after the reset operation when the reception state is within the reference range, the control circuit 34 decodes the received radio signal. When the result of the decoding is that it is possible to convert the same to time date, in other words, to reproduce the time data, it controls the count operations of the different counters based on the basic clock from the oscillating circuit 33 and outputs the control signals $CTL_1$ and $CTL_2$ to the second hand use stepping motor 210 and the hour hand and minute hand use stepping motor 410 via the buffer 37 according to the input levels of the detecting signals $DT_1$ and $DT_2$ from the first and second reflection type optical sensors 300 and 900 in order to control the rotation and thereby controls the correction of the time.

On the other hand, when the result of the decoding is that it is impossible to convert the same to time data, the control circuit 34 outputs the driving signal $DR_1$ to the drive circuit 35, without outputting the control signals $CTL_1$ and $CTL_2$, to cause the light emitting element 36 to emit light and inform the user of poor reception of the radio signal.

By this, the control circuit 34 completes the operation of the initial correction mode.

Further, the control circuit 34 controls the operation of the normal correction mode after completing the operation of the initial correction mode.

In the normal correction mode, the control circuit 34 makes a not illustrated power source supply driving power to the time radio signal receiving system 31 one minute before and after every hour, including the exact hour, so as to enable the reception of the hourly standard time radio signal S1 from the key station 1. Also, the control circuit 34 makes the not illustrated power source supply driving power to the time radio signal receiving system 31 one minute before and after 2:38 a.m., including 2:38 a.m., so as to enable reception of the radio signal S2 from the time signal repeater 2.

In this way, the control circuit 34 controls a receivable time band of the standard time radio signal S1 from the key station 1 and a receivable time band of the radio signal S2 from the time signal repeater 2 to different times so as that for example the radio signal S2 from the time signal repeater 2 does not become radio interference when the standard time radio signal S1 is received.

At the normal correction mode, in principal, the control circuit 34 receives the standard time radio signal S1 from the key station 1 and decodes the received radio signal. When the result of the decoding is that it is possible to convert the same to time data, it controls the count operations of the different counters based on the basic clock from the oscillating circuit 33 and outputs the control signals $CTL_1$ and $CTL_2$ to the second hand use stepping motor 210 and the hour hand and minute hand use stepping motor 410 via the buffer 37 according to the input levels of the detecting signals $DT_1$and $DT_2$ from the first and record reflection type optical sensors 300 and 900 in order to control the rotation and thereby controls the correction of the time. It also sets a standard radio signal normal reception flag showing that the standard time radio signal has been normally received.

When setting the standard radio signal normal reception flag, the control circuit 34 does not receive the radio signal S2 from the time signal repeater 2, namely does not make the not illustrated power source supply the driving power to the standard radio signal receiving system 31 one minute before and after 2:38 a.m., including 2:38 a.m., while resets the standard radio signal normal reception flag, receives the hourly standard time radio signal S1 from the key station 1, and corrects the time.

On the other hand, when the result of the decoding is that it is impossible to convert the same to time data, the control circuit 34 outputs, for example, the driving signal $DR_1$ to the drive circuit 35, without outputting the control signals $CTL_1$ and $CTL_2$, to cause the light emitting element 36 serving as the warning means to emit light and inform the user of poor reception of the radio signal.

In this case, the control circuit 34 receives the radio signal S2 from the time signal repeater 2. When the reception is normal, it corrects the time according to the time code of the radio signal S2 obtained by the decoding.

When the reception is not normal, the control circuit 34 considers the place where the time signal repeater 2 placed to be unsuitable and outputs for example the driving signal $DR_1$ to the drive circuit 35, without outputting the control signals $CTL_1$ and $CTL_2$, to cause the light emitting element 36 serving as the warning means emit light to inform the user.

After the completion of the time correction or when the reception of the radio signal S2 from the time signal repeater 2 is not normal and the control circuit 34 makes the light emitting element 36 emit light to inform the user etc., the control circuit 34 resets the standard radio signal normal reception flag, receives the hourly standard time radio signal S1 from the key station 1, and returns to the time correction mode.

The drive circuit 35 is constituted by an npn type transistor Q1 and resistance elements $R_1$ and $R_2$.

The collector of the transistor Q1 is connected to a cathode of a light emitting element constituted by a light emitting diode, the emitter is grounded, and the base is connected to an output line of the driving signal $DR_1$ of the control circuit 34 via the resistance element $R_2$.

The resistance element $R_1$ is connected to a supply line of the power source voltage Vcc and an anode of the light emitting element 36.

Namely, the light emitting element 36 is connected to the drive circuit 35 so as to emit light when a high level driving signal $DR_1$ is output from the control circuit 34.

The drive circuit 38 is constituted by npn type transistors Q2 and Q3 and resistance elements $R_5$ to $R_8$.

As shown in FIG. 7, the clock body 100 has a center plate 120 arranged at the substantially center portion of the space formed by a lower plate 110 and an upper plate 130 in a state connected to the lower plate 110. The second hand driving system 200, the first reflection type optical sensor 300, the second driving system 400, the hour hand wheel 500, the minute (changing) wheel 600, the manual correction shaft 700, and the second reflection type optical sensor 900 are fixed or axially supported with respect to predetermined positions of the lower plate 110, the center plate 120, and the upper plate 130 inside of the space.

The second hand driving system 200 is configured by a first stepping motor 210, a first fifth-wheel 220, and a second hand wheel 230.

The first stepping motor 210 has a stator 210*a* placed on the lower plate 110 and has a rotor 210*b* axially supported with respect to the lower plate 110 and the upper plate 130. It is controlled in direction of rotation, angle of rotation, and speed of rotation based on the control signal $CTL_1$ output from the control circuit 34 input via the buffer 37.

The first fifth-wheel 220 is axially supported with respect to the lower plate 110 and the upper plate 130, has gear teeth meshed with the rotor 210*b* of the first stepping motor 210, and reduces the speed of the rotor 210 to a predetermined speed.

The first fifth-wheel 220 is configured so as to rotate once every for example 15 seconds and is formed with a slit 220*a* in part of the area overlapping the second hand wheel 230.

The second hand wheel 230 has one end of the shaft supported with respect to the upper plate 130 and has the other side passed through the center plate 120 toward the lower plate 110 and press-fit with a second hand shaft 230*a*.

The second hand shaft 230*a* is passed through an opening 440*b* of a minute hand pipe 440*a* passing through the lower plate 110 and projecting out to a surface side where the face of the clock is formed. A not illustrated second hand is attached to the tip of the pipe.

The second hand wheel 230 has a second hand pinion meshed with a pinion of the first fifth-wheel 220 so as to rotate once every 60 seconds.

Further, a light reflecting plane 230*b* is formed at part of an area of overlap of the first fifth-wheel 220 with the second hand wheel 230 so as to face the slit 220*a* formed on the first fifth-wheel 220.

The second hand driving system 220 is configured so that the second hand points to 12 when the light reflecting plane 230*b* faces the slit 220*a*, namely the two exactly match each other.

The first reflection type optical sensor 300 is provided with a light emitting element 310 constituted by a light emitting diode and a light receiving element 320 constituted by an npn type transistor in parallel and is arranged on the upper plate 130 so that a light emitting portion of the light emitting element 310 and a light receiving surface of the light receiving element 320 are near the plane formed by the light reflecting plane 230*b* of the second hand wheel 230 via the slit 130*a* formed in the upper plate 130 and further the slit 220*a* of the first fifth-wheel 220.

An anode of light emitting element 310 of the first reflection type optical sensor 300 is connected to one end of the resistance element $R_5$ of the drive circuit 38 having another end connected to a supply line of the power source voltage Vcc, while a cathode is connected to a collector of the driving transistor Q2 provided in the drive circuit 38.

The emitter of the driving transistor Q2 is grounded, and the base is connected to an output line of the driving signal $DR_2$ of the control circuit 34 via the resistance element $R_6$.

Namely, the light emitting element 310 is connected to the drive circuit 38 so as to emit light when a high level driving signal $DR_2$ is output from the control circuit 34.

The collector of the light receiving element 320 of the first reflection type optical sensor 300 is connected to the supply line of the power source voltage Vcc and the control circuit 34, while the emitter is grounded.

Namely, the light receiving element 320 inputs a low level detecting signal $DT_2$ to the control circuit 34 only when the light emitted from the light emitting element 310 reaches the second hand wheel 320 via the slits 130*a* and 220*a* and the light reflected by the light reflecting plane 230*b* is received via the slits 130*a* and 220*a*.

The minute hand driving system 400 is configured by a second stepping motor 410, a second fifth-wheel 420, a third wheel 430, and a minute hand wheel 440.

The second hand stepping motor 410 has a stator 410*a* placed on the lower plate 110, has a rotor 410*b* axially supported with respect to the lower plate 110 and the upper plate 130, and is controlled in direction of rotation, angle of rotation, and speed of rotation based on the control signal $CTL_2$ output from the control circuit 34 via the buffer 37.

The second fifth-wheel 420 is axially supported with respect to the lower plate 110 and the upper plate 130, has gear teeth meshed with the rotor 410*b* of the second stepping motor 410, and reduces the speed of the rotor 410*b* to a predetermined speed.

The third wheel 430 has one end of a shaft portion axially supported with respect to the upper plate 130, has the other end passed through the center plate 120, and has gear teeth meshed with a pinion of the second fifth-wheel 420.

The minute hand wheel 440 forms an approximate T-shape in cross-section with an opening 440*b* at its center, has one end of the minute hand pipe 440A axially supported at the center plate 120, and has the shaft portion of the other end passed through an opening 500*b* of an hour hand pipe 500*a* of the hour hand wheel 500 passing through the lower plate 110 and projecting to the surface where the face of the clock is formed. A not illustrated minute hand is attached to the tip of the pipe.

The minute hand wheel 440 is configured to rotate once every 60 minutes.

Further, the second hand shaft 230*a* is inserted through the opening 440*b* as mentioned above. The gear teeth mesh with a pinion of the third wheel 430.

The minute hand wheel 440 is provided with a so-called slip mechanism.

The hour hand wheel 500 forms an approximate T-shape in cross-section with an opening 500*b* at its center, has gear teeth provided in the clock body 100 and has an hour hand pipe 500*a* passed though the lower plate 110 and projecting to the face side of the clock. A not illustrated hour hand is attached to the tip of the pipe.

The hour hand wheel 500 is configured so as to rotate 30° every hour and once every 12 hours.

Further, the minute hand pipe 400*a* is inserted through the opening 500*b* as mentioned above.

The slits 500*d* serving as the first light transmitting portions are formed in the surface 500*c* of the hour hand wheel 500 facing the minute hand wheel 440.

Figure 9:
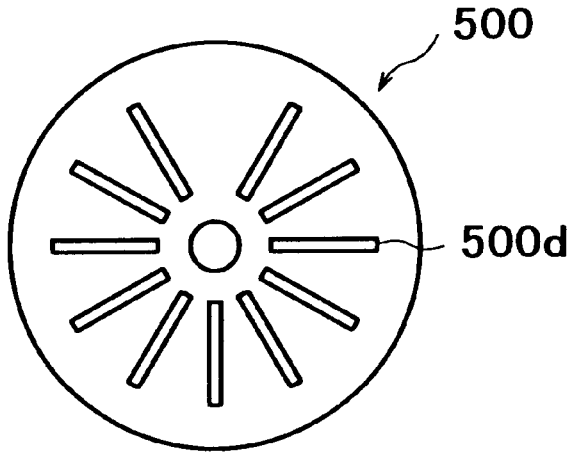
FIG. 9 is a view of an example of a pattern of formation of slits in an hour hand wheel according to the present invention.

As shown in FIG. 9, the slits 500*d* of the hour hand wheel 500 are formed in 11 locations, that is all but one location, in the 12 equally spaced locations 30° each apart in the circumferential direction of the hour hand wheel 500. Namely, the slits are formed so as not to detect a position of one hour among the 12 hours.

The minute (changing) wheel 600 is axially supported with respect to a projection portion 110*a* formed on the lower plate 110, has gear teeth meshed with the minute hand pipe 440*a* of the minute hand wheel 440, has a pinion meshed with the gear teeth of the hour hand wheel 500, reduces the speed of the minute hand wheel 440 to a predetermined speed, and transfers the rotation to the hour hand wheel 500.

Further, the date wheel 600 is configured so as to rotate once every N (N is a positive integer) number of hours, has gear teeth meshed with a correction pinion 700*a* of the manual correction shaft 700, and is arranged so that part faces part of the rotary detection plate 800.

The manual correction shaft 700 forms an approximate T-shape in cross-section, has a correction pinion 700*a* axially supported with respect to a projection formed on the lower plate 110 in the state passing through an opening 130*b* formed in the upper plate 130, and has a head portion 700*b* arranged in a state projecting out from the upper plate 130 to the outside of the clock body 100.

The manual correction shaft 700 is configured to rotate once every 60 minutes at the same phase as the minute hand wheel 440. As explained above, the correction pinion 700*a* meshes with the gear teeth of the date wheel 600. When the minute hand wheel 440 is driven by the minute hand driving system 400, the shaft rotates at the same phase as the minute hand wheel 440 via the minute wheel 600. When the minute hand driving system 400 is not operating, the shaft enables manual correction of the positions of the hands by rotating the head portion 700*b*.

The rotary detection plate 800 forms a disk shape and is fixed at its center substantially coaxially with the shaft portion of the minute hand wheel 440 between the minute hand wheel 440 and the hour hand wheel 500 so as to rotate according to the rotation of the minute hand wheel 440.

Figure 10:
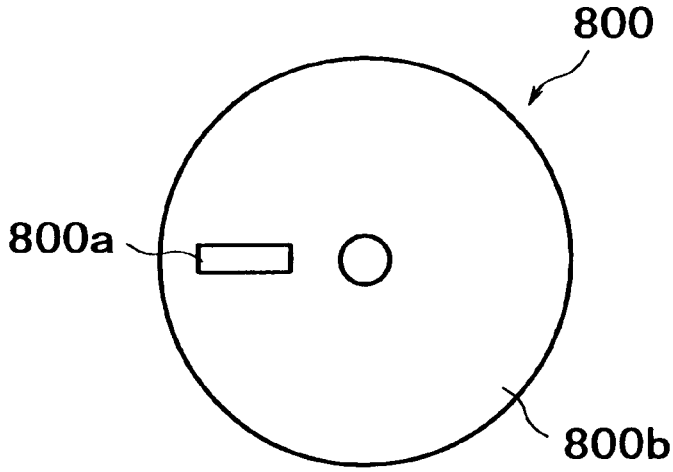
FIG. 10 is a view of an example of a pattern of formation of a light reflecting plane of a rotary detecting plate according to the present invention.

As shown in FIG. 10, a light reflecting plane 800*a* serving as a second light transmitting portion is formed at the part of an area of the rotary detection plate 800 overlapping the surface 500*c* of the hour hand wheel 500 so as to face the slit 500*d*.

The second reflection type optical sensor 900 is provided with a light emitting element 910 constituted by a light emitting diode and a light receiving element 920 constituted by an npn type transistor in parallel and is arranged on the lower plate 110 so that a light emitting portion of the light emitting element 910 and a light receiving surface of the light receiving element 920 are near the plane 800*b* formed by the light reflecting plane 800*a* of the rotary detection plate 800 via the slit 110*c* formed in the lower plate 110 and the slit 500*d* formed in the hour hand wheel 500.

An anode of the light emitting element 910 of the second reflection type optical sensor 900 is connected to one end of the resistance element $R_7$ of the drive circuit 38 having the other end connected to the supply line of he power source voltage Vcc, while a cathode is connected to a collector of the driving transistor Q3 provided in the drive circuit 38.

The emitter of the driving transistor Q3 is grounded, and the base is connected to an output line of the driving signal $DR_3$ of the control circuit 34 via the resistance element $R_6$.

Namely, the light emitting element 910 is connected to the drive circuit 38 so as to emit light when a high level driving signal $DR_3$ is output from the control circuit 34.

The collector of the light receiving element 920 of the second refection type optical sensor 900 is connected to the supply line of the power source voltage Vcc and the control circuit 34, and the emitter is grounded.

Namely, the light receiving element 920 inputs a low level detecting signal $DT_2$ to the control circuit 34 only when the light emitted from the light emitting element 910 reaches the surface 800*b* of the rotary detection plate 800 via the slit 500*d* and the light reflected by the light reflecting plane 800*a* is received via the slit 500*d*.

Note that the relationship between the light reflecting plane 800*a* of the rotary detection plate 800 and the slit 500*d* of the hour hand wheel 500 is set so as that the not illustrated minute hand and hour hand point to every hour when the light reflecting area 800*a* faces the slit 500*d*.

Next, an explanation will be made of the operation for control of time correction of the above configuration.

Note that, here, the explanation will be made taking as an example a normal mode operation of the minute hand system.

For example, in Japan, the long wave (40 kHz) standard time radio signal S1 of the format for example as shown in FIG. 5A is amplitude modulated and transmitted from the key station 1.

In this case, in the time signal repeater 2, for example, the change-over switch is set to the resonance frequency of 40 kHz.

Due to this, the control signal CTL is supplied to the switch SW201 of the receiving antenna portion 201 at the high level and the selection signal SLC is supplied to the selecting circuit 209 at the high level.

In the receiving antenna portion 210, the switch SW210 is held in an ON state by reception of the high level control signal CTL. Two capacitors C201 and C202 are connected in parallel to the resonance coil L210.

Due to this, the resonance frequency of the receiving antenna portion 201 is set to 40 kHz.

Further, in the selecting circuit 209, the fixed contacts a of the switch circuit SW2091 and SW2092 are connected to the change-over contacts b by receiving a high level selection signal, namely, the connection is changed so as to directly input the oscillating signal S207 of the PLL circuit 207 to the analog switch 210.

In this state, the 40 kHz frequency standard time radio signal S1 transmitted from the key station 1 is received by the receiving antenna portion 201 of the time signal repeater 2 and the receiving antenna 31*a* of the radio correction clock 3.

In the time signal repeater 2, the standard time radio signal S1 received by the receiving antenna portion 201 is converted to the baseband signal of the standard time radio signal S1 shown in FIG. 2B through the reception use RF amplifier 202, the detection circuit 203, the rectifier circuit 204, and the integrating circuit 205. The converted baseband signal is input to the microcomputer 206 and the PLL circuit 207.

In the PLL circuit 207, the phases of the standard time signal and the output signal of the VCO 2073 are compared in the phase comparator 2071, the phase of the oscillating signal S207 of the VCO 2073 is controlled to lock with the phase of the standard time signal, and the oscillating signal S207 synchronized in phase with the phase of the received standard time radio signal S1 and of the frequency of the standard time radio signal S1 is output from the VCO 2073.

The oscillating signal S207 is directly input to the analog switch 210 via the selecting circuit 209.

In the microcomputer 206, the baseband signal from the integrating circuit 205 is received, the time code of JG2AS is decoded to obtain time data such as the hour-minute-00 seconds, and the internal clock is corrected.

Further, at the predetermined transmission time (for example, 2:38 a.m.) band, the time data to be transmitted is generated based on a time counted by the internal clock.

Next, the time data is output to the control terminal of the analog switch 210 by the same format as the baseband signal of JG2AS as the gate pulse S206.

Due to this, the time radio signal S2 shown in FIG. 5B is generated and transmitted from the transmission antenna 212 to the radio correction clock 3.

Further, when using a radio correction clock 3 of a receiving frequency set to 40 kHz in the U.S., where the frequency of the standard time radio signal is 60 kHz, the change-over switch in the time signal repeater 2 is set to a resonance frequency of 60 kHz.

Due to this, the control signal CTL is supplied to the switch SW201 of the receiving antenna portion 201 at the low level and the selection signal SLC is supplied to the selecting circuit 209 at the low level.

In the receiving antenna portion 201, the switch SW201 is held in an OFF state by reception of a low level control signal CTL. By this, one capacitor C201 is connected in parallel to the resonance coil L201.

Due to this, the resonance frequency of the receiving antenna portion 201 is set to 60 kHz.

Further, in the selecting circuit 209, the fixed contacts a of the switch circuit SW2091 and SW2092 are connected to the change-over contacts c by reception of the low level selection signal, namely, the connection is changed so as to input the oscillating signal S207 of the PLL circuit 207 to the analog switch 210 via the frequency conversion circuit 208.

In this state, the 60 kHz frequency standard time radio signal S1 transmitted from the key station 1 is received by the receiving antenna portion 201 of the time signal repeater 2.

In the time signal repeater 2, the standard time radio signal S1 received by the receiving antenna portion 201 is converted to the baseband signal of the standard time radio signal S1 shown in FIG. 2B through the reception use RF amplifier 202, detection circuit 203, rectifier circuit 204, and integrating circuit 205 and input to the microcomputer 206 and input to the PLL circuit 207.

In the PLL circuit 207, the phases of the standard time signal and the output signal of the VCO 2073 are compared in the phase comparator 2071, the phase of the oscillating signal S207 of the VCO 2073 is controlled to lock with the phase of the standard time signal, and the oscillating signal S207 synchronized in phase with the received standard time radio signal S1 and of the same frequency as the standard time radio signal S1 is output from the VCO 2073.

The oscillating signal S207 is input to the frequency conversion circuit 208 via the selecting circuit 209.

In the frequency conversion circuit 208, the 60 kHz frequency oscillating signal 207 is divided to ⅔ to convert it to a frequency of 40 kHz and is output to the analog switch 218.

In the microcomputer 206, a similar operation is performed as in the case of 40 kHz explained above.

Namely, the baseband signal of the integrating circuit 205 is received, the time code of JG2AS is decoded to obtain time data such as the hour-minute-00 second, and the internal clock is corrected.

Further, at the predetermined transmission time (for example, 2:38 a.m.) band, the time data to the transmitted is generated based on the time counted by the internal clock.

Then, the time data is output to the control terminal of the analog switch 210 by the same format as the baseband signal of JG2AS as the gate pulse S206.

Due to this, the time radio signal S2 shown in FIG. 5B is generated and transmitted from the transmission antenna 212 to the radio correction clock 3.

In the radio correction clock 3, the control circuit 34 makes a not illustrated power source supply driving power to the time radio signal receiving system 31 one minute before and after every hour, including the hour, to enable reception of the standard time radio signal S1 from the key station 1 at every hour.

Due to this, the long wave (for example 40 kHz) received by the receiving antenna 31*a* of the time radio signal receiving system 31 and including the time code signal transmitted from the key station 1 is subjected to predetermined signal processing at the long wave receiving circuit 31*b* and output to the control circuit 34 as the pulse signal S31.

In the control circuit 34, the received radio signal is decoded. When the result of the decoding is that reception is normal, control is performed to correct the time by controlling the counts of the different counters based on the basic clock from the oscillating circuit 33 and output of the control signals $CTL_1$ and $CTL_2$ to the second hand use stepping motor 210 and the hour and minute hand use stepping motor 410 via the buffer 37 according to the input levels of the detecting signals $DT_1$ and $DT_2$ from the first and second reflection type optical sensors 300 and 900 in order to control the rotation.

Next, the standard radio signal normal reception flag showing that the standard time radio signal has been normally received is set.

When the current time is not the receiving time of the standard time radio signal S1 or the reception is judged not normal or the standard radio signal normal reception flag has been set, it is judged if the current time is the receiving time of the time radio signal S2 from the time signal repeater 2 or not.

Here, when it is judged that the time is the receiving time of the time radio signal S2 and the standard radio signal normal reception flag has been set, driving power is not supplied from the not illustrated power source to the standard radio signal receiving system 31 one minute before and after 2:38 a.m., including 2:38 a.m. When the standard radio signal normal reception flag has been reset, the processing shifts to normal processing.

On the other hand, when the standard radio signal normal reception flag has not been set, the driving power is supplied from the not illustrated power source to the standard radio signal receiving system 31 one minute before and after 2:38 a.m., including 2:38 a.m., to enable reception of the time radio signal S2 from the time signal repeater 2.

In this case, the time radio signal transmitted from the time signal repeater 2 is received.

At this time, when the reception is normal, control is performed to correct the time by controlling the counts of the different counters based on the basic clock from the oscillating circuit 33 and output of the control signals $CTL_1$ and $CTL_2$ to the second hand use stepping motor 210 and the hour and minute hand use stepping motor 410 via the buffer 37 according to the input levels of the detecting signals $DT_1$ and $DT_2$ from the first and second reflection type optical sensors 300 and 900 in order to control the rotation.

On the other hand, when the reception is not normal, it is considered that place where the time signal repeater 2 is placed is unsuitable, the driving signal $DR_1$ is output to the drive circuit 35, without outputting the control signals $CTL_1$ and $CTL_2$, and the light emitting element 36 emits light to inform the user.

As explained above, according to the present embodiment, there is provided a time signal repeater 2 comprising an antenna portion 201 capable of being set to a plurality of resonance frequencies and receiving a standard time radio signal S1 with a set resonance frequency, a PLL circuit 207 outputting a signal S207 having a frequency of the received standard time radio signal in synchronization with the standard time radio signal received by the antenna portion 201, a frequency conversion circuit 208 converting the frequency of the output signal of the PLL circuit 207, receiving system circuits 206 to 208 receiving as input the standard time radio signal received by the antenna portion 201 and correcting the time of an internal clock according to a time code included in the received radio signal, transmission system circuits 206 and 210 to 212 generating a time radio signal including a time code based on the internal clock based on the output signal of the PLL circuit 207 or a signal converted in frequency by the frequency conversion circuit 208 and transmitting it at the time of transmission, and a selecting circuit 209 receiving as input the output signal of the PLL circuit 207 or a signal converted in frequency by the frequency conversion circuit 208 to an analog switch 210 according to a selection signal SLC, so it is possible to selectively relay standard time radio signals having different modulation frequencies.

As a result, there are the advantages that it is possible to correct the time based on a plurality of standard time radio signals without changing the radio correction clock side, reduce the cost, and realize a practical time correction system.

Note that although the embodiment was explained with reference to an example of a configuration in which one frequency conversion circuit is provided, needless to say the present invention is not limited to this. It can also be applied to a variety of other embodiments, for example, one further providing another frequency conversion circuit having a different division ratio and switching between the two frequency conversion circuits according to the specifications.

Further, since the control circuit 34 judges whether the received signal can be converted to time data or not, corrects the positions of the hands when possible, and informs the user that conversion is impossible by making the light emitting element 36 emit light, there is the advantage that it is possible to always recognize the state of reception of the radio signal at the time of operation.

Summarizing the effects of the inventions, as explained above, according to the present invention, it is possible to selectively relay standard time radio signals having different modulation frequencies.

As a result, it is possible to correct time based on a plurality of standard time radio signals without changing the radio correction clock side.

While the invention has been described with reference to a specific embodiment chosen for purpose of illustration, it should be apparent that numerous modifications could be made thereto by those skilled in the art without departing from the basic concept and scope of the invention.

What is claimed is:

1. A time signal repeater which relays a radio signal including a time code for a radio correction clock receiving a standard time radio signal to correct the time, comprising:

an antenna portion capable of setting a plurality of resonance frequencies and receiving the standard time radio signal by a set resonance frequency, an oscillating circuit for outputting a signal having a frequency of the received standard time radio signal and synchronized with the standard time radio signal received by the antenna portion, at least one frequency conversion circuit for converting the frequency of the output signal of the oscillating circuit, a receiving circuit for receiving as input the standard time radio signal received by the antenna portion and correcting the time of an internal clock according to the time code included in the received radio signal, a transmission circuit for generating a time radio signal including a time code based on the internal clock based on the output signal of the oscillating circuit or the signal converted in frequency by the frequency conversion circuit at the time of transmission, and a selecting circuit for receiving as input the output signal of the oscillating circuit or the signal converted in frequency by the frequency conversion circuit to the transmission circuit.

2. A time signal repeater as set forth in claim 1, wherein the transmission circuit modulates an input signal with a different modulation system from an amplitude modulation system of the standard time radio signal.

3. A time correction system comprising:

a radio correction clock fixed in reception frequency, receiving a standard time radio signal or radio signal obtained by relaying the standard time signal, and correcting the time to a time according to a time code included in the received signal, and a time signal repeater which has an antenna portion capable of setting a plurality of resonance frequencies and receiving the standard time radio signal with a set resonance frequency, an oscillating circuit for outputting a signal having a frequency of the received standard time radio signal and synchronized with the standard time radio signal received by the antenna portion, at least one frequency conversion circuit for converting the frequency of the output signal of the oscillating circuit, a receiving circuit for receiving as input the standard time radio signal received by the antenna portion and correcting the time of an internal clock according to the time code included in the received radio signal, a transmission circuit for generating a time radio signal including a time code based on the internal clock based on the output signal of the oscillating circuit or the signal converted in frequency by the frequency conversion circuit at the time of transmission, and a selecting circuit for receiving as input the output signal of the oscillating circuit or the signal converted in frequency by the frequency conversion circuit to the transmission circuit.

4. A time correction system as set forth in claim 3, wherein the transmission circuit modulates an input signal with a different modulation system from an amplitude modulation system of the standard time radio signal.

* * * * *